United States Patent [19]

Kato et al.

[11] Patent Number: 4,857,431

[45] Date of Patent: Aug. 15, 1989

[54] PHOTOCONDUCTIVE COMPOSITION

[75] Inventors: Eiichi Kato; Kazuo Ishii, both of Shizuoka, Japan

[73] Assignee: Fuji Photo Film Co., Ltd., Kanagawa, Japan

[21] Appl. No.: 121,250

[22] Filed: Nov. 16, 1987

[30] Foreign Application Priority Data

Nov. 14, 1986 [JP] Japan ..... 61-269954

[51] Int. Cl.[4] ..... G03G 5/087; G03G 5/09

[52] U.S. Cl. ..... 430/91; 430/92; 430/93; 430/95

[58] Field of Search ..... 430/91, 92, 93, 95

[56] References Cited

U.S. PATENT DOCUMENTS 3,772,281 11/1973 Tubuko et al. ..... 430/93 X 3,852,067 12/1974 Levy ..... 430/95 X 4,386,146 5/1943 Kishino et al. ..... 430/95

*Primary Examiner*—Paul R. Michl

*Assistant Examiner*—Jeffrey A. Lindeman

*Attorney, Agent, or Firm*—Sughrue, Mion, Zinn, Macpeak & Seas

[57] ABSTRACT

A photoconductive composition is disclosed, comprising at least an inorganic photoconductive material, a sensitizing dye and a resin binder wherein the sensitizing dye is a compound containing at least one acidic group in the molecule thereof as represented by the formula (I):

(I)

wherein all the symbols are as defined in the appended claims.

14 Claims, No Drawings

PHOTOCONDUCTIVE COMPOSITION

FIELD OF THE INVENTION

The present invention relates to a photoconductive composition containing a resin binder and an inorganic photoconductive material dispersed in the resin binder wherein the inorganic photoconductive material is spectrally sensitized with dyes. More particularly, this invention relates to a photoconductive composition which is spectrally sensitized to light in the range from red light to infrared.

BACKGROUND OF THE INVENTION

A number of dyes for spectral sensitization (spectral sensitizing dyes) which are used in an electrophotographic light-sensitive layer containing a photoconductive material and a resin binder system are known. These spectral sensitizing dyes must fulfill various requirements. Particularly important properties among others include good adsorption onto the photoconductive material, high sensitizing efficiency, and a minimum necessary resistance of the electrophotographic light-sensitive layer in the dark. Examples of dyes satisfying the above requirements are described in U.S. Pat. Nos. 3,052,540, 3,110,591, 3,125,447, 3,128,179, 3,132,942, 3,241,959 and 3,121,008, and British Patent No. 1,093,823.

Spectral sensitizing dyes for sensitization in the range from red light to infrared are described in U.S. Pat. Nos. 3,619,154 and 3,682,630. These dyes, however, have the serious disadvantage for practical use that they are generally easily decomposed, during storage or during the process for preparing an electrophotographic light-sensitive layer containing such dyes or its storage, thereby reducing performance. In this regard, Harazaki et al. describe in *Kogyo Kagaku Zasshi* (*Journal of Industrial Chemistry*), Vol. 66, No. 2, p. 26 (1963) that sensitizing dyes for sensitization from red light to infrared are more unstable than those for short wavelength light (visible light).

In recent years, with development of low output semiconductor lasers, light-sensitive materials which are of high sensitization for long wavelength light of more than 700 nm have been extensively investigated. Cyanine dyes for spectral sensitization using zinc oxide as a photoconductive substance are described in Japanese Patent Application (OPI) Nos. 58554/83, 42055/83, 59453/83, etc. (the term "OPI" as used herein means a "published unexamined Japanese patent application").

However, the sensitivity of these cyanine dyes does not include the wavelengths from near infrared to infrared light, and the stability of the light-sensitive material is not sufficiently high, preventing the attainment of satisfactory high sensitivity.

Dyes which exhibit high sensitization efficiency to long wavelength light are earnestly desired, but dyes which satisfy this requirement are still not available.

SUMMARY OF THE INVENTION

An object of the present invention is to provide an inorganic photoconductive substance/resin-based photoconductive composition which is excellent in storage stability containing a spectral sensitizing dye for red light to infrared.

Another object of the present invention is to provide a photoconductive composition which can be used as a light-sensitive material for an electrophotographic system using a laser light source.

A further object of the present invention is to provide a photoconductive composition containing as a spectral sensitizer a novel dye which is colorless and transparent, has an absorption in the range from far infrared to near infrared, and also provides a high sensitization efficiency.

It has now been found that these and other objects can be achieved by using a sensitizing dye containing at least one acidic group represented by formula (I) described below.

Accordingly, the present invention relates to a photoconductive composition containing an inorganic photoconductive material, a resin binder, and a sensitizing dye containing at least one acidic group represented by formula (I):

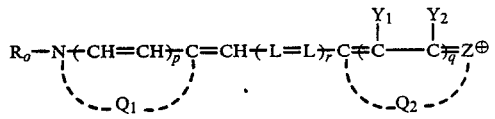

(I)

wherein:

$Q_1$ represents a substituted or unsubstituted atomic group necessary for forming a 5-membered or 6-membered heterocyclic ring or a condensed ring containing a 5-membered or 6-membered heterocyclic ring;

$R_0$ represents an alkyl group, a hydroxyalkyl group, an alkoxyalkyl group, an aralkyl group, a carboxyalkyl group, or a sulfoalkyl group;

Z represents an oxygen atom, a sulfur atom, a selenium atom or a tellurium atom;

$Q_2$ represents a substituted or unsubstituted atomic group necessary for forming pyrylium, benzopyrylium, naphthopyrylium, thiopyrylium, benzothiopyrylium, naphthothiopyrylium, selenapyrylium, benzoselenapyrylium, naphthoselenapyrylium, ternapyrylium, benzoternapyrylium, or naphthoternapyrylium;

$Y_1$ and $Y_2$, which may be the same or different, each represents a hydrogen atom, an aliphatic group or an aromatic group;

each L represents a methine group or a substituted methine group;

p and q each is 0 or 1;

r is 2 or 3;

and the compound of formula (I) forms an inner salt.

The acidic group contained in the compound represented by formula (I) is preferably selected from a sulfo group and a carboxyl group, and is capable of forming an anionic group, preferably $-SO_3^{\ominus}$ or $-COO^{\ominus}$ which forms an inner salt with the cation $Z^{\oplus}$ present in the compound of formula (I).

DETAILED DESCRIPTION OF THE INVENTION

The acidic group contained in the compounds of the formula (I) may be positioned at any point of the dye molecule, but is preferably contained in the moiety of $R_0$, $Q_1$ or L.

Preferred examples of each substituent in the formula (I) are described below in detail.

The heterocyclic ring formed by $Q_1$ includes a thiazole ring, a benzothiazole ring, a naphthothiazole ring (e.g., a naphtho[2,1-d]thiazole ring and a naphtho[1,2-d]thiazole ring), a thionaphthene[7,6-d] ring, an oxazole ring, a benzoxazole ring, a naphthoxazole ring (e.g., naphtho[2,1-d]oxazole ring), a selenazole ring, a benzoselenazole ring, a naphthoselenazole ring (e.g., a naphtho[2,1-d]selenazole ring and a naphtho[1,2-d]selenazole ring), an oxazolone ring, a selenazoline ring, a thiazoline ring, a pyridine ring, a quinoline ring (e.g., a 2-quinoline ring and a 4-quinoline ring), an isoquinoline ring (e.g., a 1-isoquinoline ring and a 3-isoquinoline ring), an acridine ring, a 3,3-di-alkylindolenine ring, and a benzimidazole ring.

Examples of the substituent for the heterocyclic ring formed by $Q_1$ include a halogen atom (e.g., a chlorine atom and bromine atom), a substituted or unsubstituted alkyl group having 1 to 22 carbon atoms (e.g., a methyl group, ethyl group, propyl group, butyl group, pentyl group, hexyl group, octyl group, decyl group, chloromethyl group, trifluoromethyl group, cyanomethyl group and hydroxyethyl group), a substituted or unsubstituted aralkyl group having 7 to 22 carbon atoms (e.g., a benzyl group, phenethyl group and γ-phenylpropyl group), a substituted or unsubstituted aryl group having 6 to 22 carbon atoms (e.g., a phenyl group, naphthyl group, chlorophenyl group, dichlorophenyl group, methoxyphenyl group, ethoxyphenyl group, hydroxyphenyl group and methoxycarbonylphenyl group), a substituted or unsubstituted heterocyclic group having 4 or more carbon atoms (e.g., thienyl group, pyridyl group and furyl group), a hydroxyl group, a cyano group, a nitro group, a carboxyl group, a sulfo group, an alkoxy group having 1 to 22 carbon atoms (e.g., a methoxy group, ethoxy group, propoxy group, butoxy group, sulfopropoxy group and benzyloxy group), an aryloxy group having 6 to 22 carbon atoms (e.g., phenoxy group, chlorophenoxy group, methoxyphenoxy group and dichlorophenoxy group), a carboxylic acid ester group (where the ester radical is, for example, a methyl group, an ethyl group, a butyl group, a hexyl group, a cyclohexyl group, a benzyl group, a phenyl group, or a furyl group), an amino group, a mono- or di-substituted amino group (where the substituent is, for example, a methyl group, an ethyl group, a propyl group, a butyl group, a hexyl group, an octyl group, a decyl group, a cylohexyl group, a benzyl group, a phenethyl group, a phenyl group, a chlorophenyl group, a methylphenyl group, a methoxyphenyl group and a butylphenyl group), a substituted or unsubstituted alkylsulfonyl group having 1 to 22 carbon atoms (where the alkyl group is, for example, a methyl group, an ethyl group, a propyl group, a butyl group, a hexyl group, or an ethoxyethyl group), a substituted or unsubstituted arylsulfonyl group having 6 to 22 carbon atoms (where the aryl group is, for example, a phenyl group, a chlorophenyl group, a methoxyphenyl group or a dichlorophenyl group), a substituted or unsubstituted acyl group having 2 to 22 carbon atoms (e.g., an acetyl group, propionyl group, butyryl group, valeryl group, pivalyl group, lauroyl group, benzoyl group, toluoyl group, naphthoyl group, furoyl group and thenoyl group), a substituted or unsubstituted carboamido group having 1 to 22 carbon atoms derived from an aliphatic or aromatic carboxylic acid group (e.g., an acetamido group, chloroacetamido group, propionamido group and benzamido group), and a substituted or unsubstituted sulfonamido group having 1 to 22 carbon atoms derived from an aliphatic or aromatic sulfonic acid (e.g., a methanesulfonamido group, trifluoromethanesulfonamido group, benzenesulfonamido group and toluenesulfonamido group).

When $R_0$ represents an alkyl group, examples of the alkyl group are those having 1 to 18 carbon atoms and include a methyl group, an ethyl group, a propyl group, a butyl group, an isopropyl group, an isobutyl group, a pentyl group and an isoamyl group. When $R_0$ represents a hydroxyalkyl group, examples of the hydroxyalkyl group include a 2-hydroxyethyl group and a 3-hydroxybutyl group. When $R_0$ represents an alkoxyalkyl group, examples of the alkoxyalkyl group include a 2-methoxyethyl group, and a 2-ethoxyethyl group. When R represents a carboxyalkyl group, examples of the carboxyalkyl group are a carboxymethyl group, a 2-carboxyethyl group, a 1-carboxyethyl group, a 3-carboxypropyl group and a 4-carboxybutyl group. The carboxyl group of the carboxyalkyl group may form a salt with an alkali metal such as lithium, sodium, potassium, etc., ammonium, or an organic base such as pyridine, morpholine, piperidine, triethylamine, etc. When $R_0$ represents a sulfoalkyl group, examples of the sulfoalkyl group include a sulfomethyl group, a 2-sulfoethyl group, a 3-sulfopropyl group and a 4-sulfobutyl group. The sulfo group of the sulfoalkyl group may form a salt with an alkali metal such as lithium, sodium, potassium, etc., ammonium, or an organic base such as pyridine, morpholine, piperidine, triethylamine, etc. When $R_0$ represents an aralkyl group, examples of the aralkyl group are a benzyl group and a phenethyl group.

Z represents an oxygen atom, a sulfur atom, a selenium atom or a tellurium atom.

$Q_2$ represents an atomic group necessary for forming pyrylium, benzopyrylium, naphthopyrylium, thiopyrylium, benzothiopyrylium, naphthothiopyrylium, selenapyrylium, benzoselenapyrylium, naphthoselenapyrylium, ternapyrylium, benzoternapyrylium or naphthoternapyrylium, each of which may be substituted.

Examples of the substituent which may be present in each of the above pyrylium moiety contained in $Q_2$ include a halogen atom (e.g., a chlorine atom and a bromine atom), a substituted or unsubstituted alkyl group having 1 to 22 carbon atoms (e.g., a methyl group, an ethyl group, a propyl group, a butyl group, a pentyl group, a hexyl group, an octyl group, a chloromethyl group, a cyanomethyl group and a hydroxyethyl group), an alkoxy group having 1 to 20 carbon atoms (e.g., a methoxy group, an ethoxy group, a propyoxy group, a butyloxy group, a hexyloxy group and a decyloxy group), a substituted or unsubstituted aralkyl group having 7 to 22 carbon atoms (e.g., a benzyl group and a phenethyl group), a substituted or unsubstituted aryl group having 6 to 22 carbon atoms (e.g., a phenyl group, a tolyl group, a naphthyl group, a chlorophenyl group, a dichlorophenyl group, a butylphenyl group, a methoxyphenyl group, an ethoxyphenyl group, a hydroxyphenyl group, an N,N-dimethylaminophenyl group, a methoxycarbonylphenyl group, an ethoxycarbonylphenyl group, a cyanophenyl group and a methanesulfonyl group), a hydroxyl group, a cyano group, an alkyloxycarbonyl group having 1 to 22 carbon atoms (e.g., a methoxycarbonyl group, an ethoxycarbonyl group, a propoxycarbonyl group and a butoxycarbonyl group), an aryloxycarbonyl group having 6 to 22 carbon atoms (e.g., a phenyloxycarbonyl group, a chlorophenyloxycarbonyl group, a tolyloxycarbonyl group, a butylphenyloxycarbonyl group and a methoxyphenyloxycarbonyl group), an alkanesulfonyl group having 1 to 22 carbon atoms (e.g., a methanesulfonyl group, an ethanesulfonyl group, a propanesulfonyl group, a butanesulfonyl group and a hexylsulfonyl group), an arylsulfonyl group having 6 to 22 carbon atoms (e.g., a benzenesulfonyl group), and a substituted or unsubstituted amino group having 1 to 28 carbon atoms (e.g., an amino group, an N-methylamino group, an N,N-dimethylamino group, an N-ethylamino group, an N,N-diethylamino group, an N,N-dipropylamino group, an N,N-dibutylamino group, an N-methyl-N-phenylamino group, an Nphenylamino group and an N-benzylamino group).

$Y_1$ and $Y_2$, which may be the same or different, each represents a hydrogen atom, a substituted or unsubstituted alkyl group having 1 to 22 carbon atoms (e.g., a methyl group, an ethyl group, a propyl group, a butyl group, a pentyl group, a hexyl group, an octyl group, a decyl group, a dodecyl group and a tetradecyl group), a substituted or unsubstituted cycloalkyl group having 5 to 22 carbon atoms (e.g., a cyclopentyl group and a cyclohexyl group), a substituted or unsubstituted aralkyl group having 7 to 22 carbon atoms (e.g., a benzyl group and a phenethyl group), and a substituted or unsubstituted aryl group having 6 to 22 carbon atoms (e.g., a phenyl group, a tolyl group, a butylphenyl group, a chlorophenyl group, a dichlorophenyl group, a methoxyphenyl group, a naphthyl group, a bromophenyl group, a cyanophenyl group, a methanesulfonylphenyl group, an N,N-dimethylaminophenyl group, an N,N-dibutylaminophenyl group, a methoxycarbonylphenyl group and an ethoxycarboxylphenyl group). Examples of substituents for the alkyl and cycloalkyl groups include a halogen atom such as chlorine, bromine, etc., and an alkoxy group such as methoxy, ethoxy, butoxy, etc.; examples of substituents for the aralkyl group include a halogen atom such as chlorine, bromine, etc., an alkyl group such as methyl, ethyl, butyl, etc., and an alkoxy group such as methoxy, ethoxy, butoxy, etc.; and examples of substituents for the aryl group include an alkyl group, a halogen atom, and an alkoxy group as described above, as well as a cyano group, a sulfonyl group such as methanesulfonyl, ethanesulfonyl, etc., an amino group such as amino, dimethylamino, diethylamino, dibutylamino, etc., and a carboxylic acid ester such as methoxycarbonyl, ethoxycarbonyl, etc.

L is a methine group or a substituted methine group. Each of four L's (when r is 2) and six L's (when r is 3) may be the same or different. Preferred examples of the substituent of the substituted methine group include a halogen atom (e.g., a chlorine atom and a bromine atom), a carboxyl group, a hydroxyl group, an alkyl group having 1 to 5 carbon atoms (e.g., a methyl group, an ethyl group, a propyl group and a butyl group), an alkoxy group having 1 to 5 carbon atoms (e.g., a methoxy group, an ethoxy group and a propoxy group), an aralkyl group having 7 to 12 carbon atoms (e.g., a benzyl group and a phenethyl group), a substituted or unsubstituted aryl group (e.g., a phenyl group, a naphthyl group, an indenyl group, a tolyl group, an ethylphenyl group, a xylyl group, a mesityl group, a cumenyl group, a methylnaphthyl group, an ethylnaphthyl group, a chlorophenyl group, a bromophenyl group, a chloronaphthyl group, a methoxyphenyl group and an ethoxyphenyl group), and a group $$-\overset{\overset{\displaystyle O}{\|}}{C}-O-R_3$$

(wherein $R_3$ represents an alkyl group such as a methyl group, an ethyl group, a propyl group and a butyl group, an aralkyl group such as a benzyl group and a phenethyl group, or an aryl group such as a phenyl group and a tolyl group).

Representative examples of the compounds represented by the formula (I) of the present invention are shown below, but the present invention is not to be construed as being limited thereto.

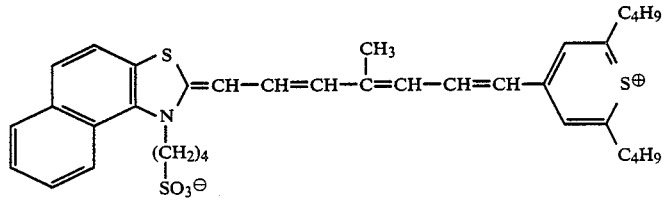

Compound (1)

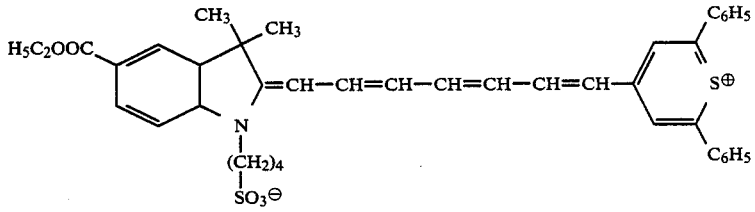

Compound (2)

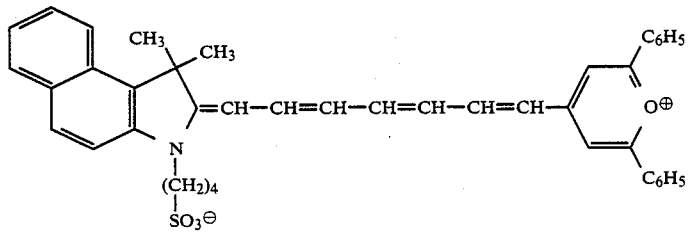

Compound (3)

-continued
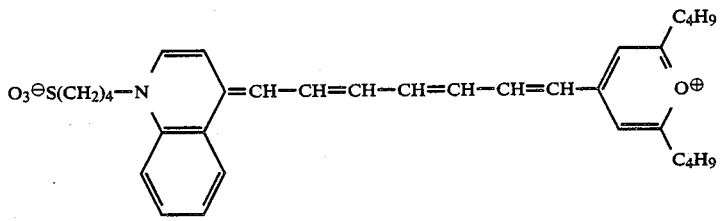
Compound (4)
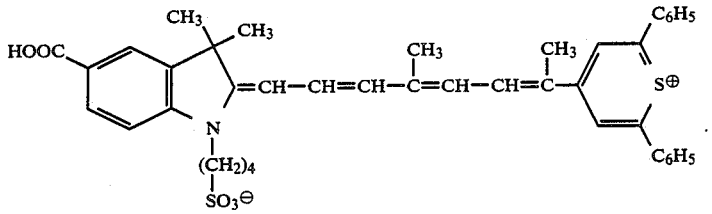
Compound (5)
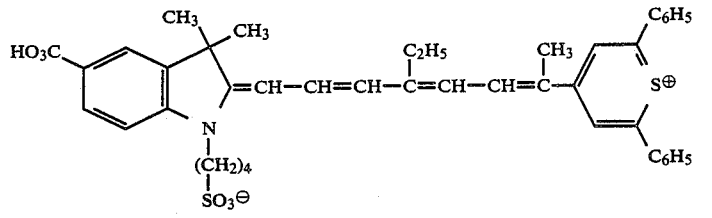
Compound (6)
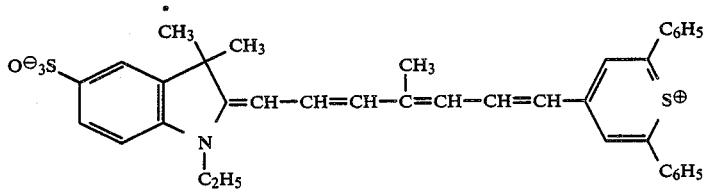
Compound (7)
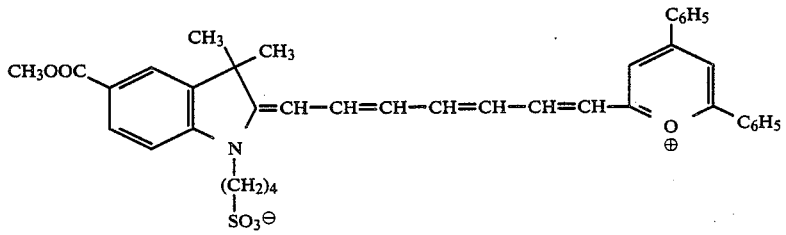
Compound (8)
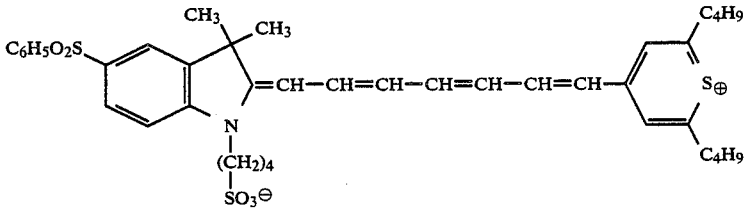
Compound (9)
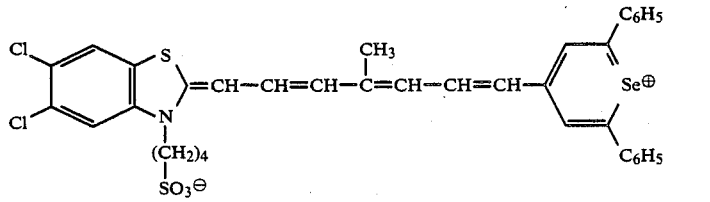
Compound (10)

-continued
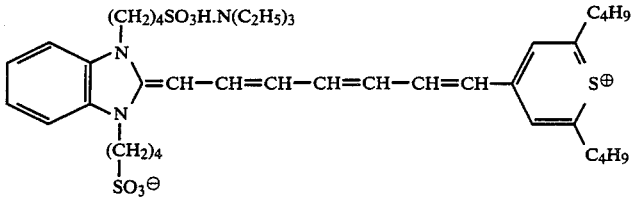
Compound (11)
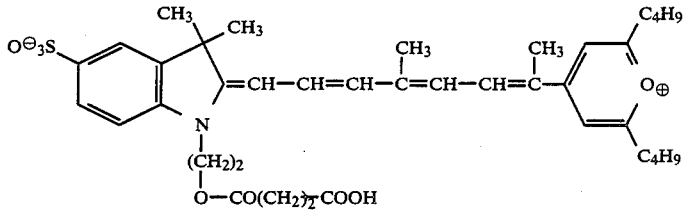
Compound (12)
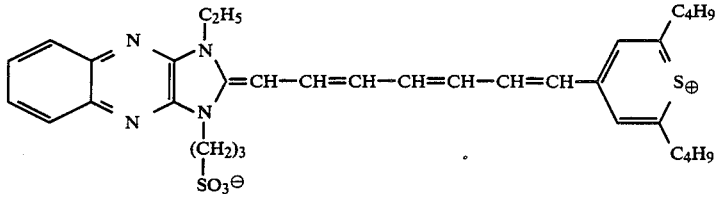
Compound (13)
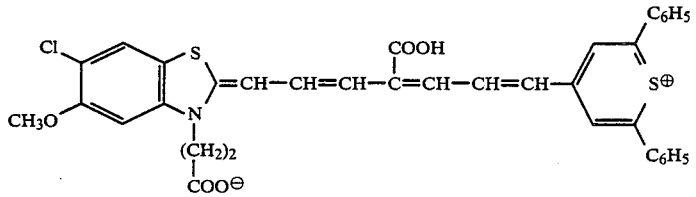
Compound (14)
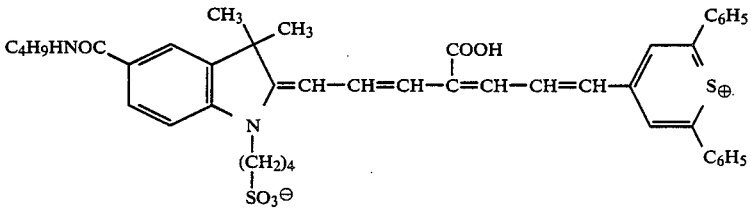
Compound (15)
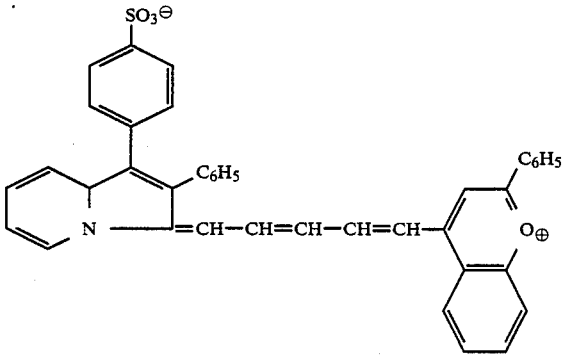
Compound (16)

-continued

Compound (17)

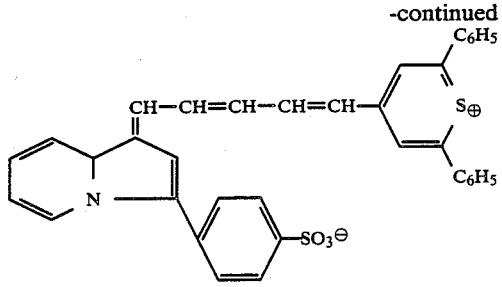

Compound (18)

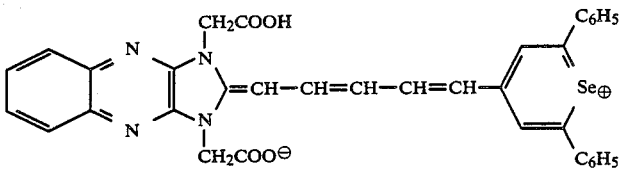

Compound (19)

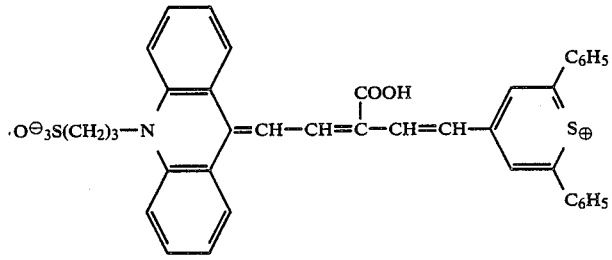

Compound (20)

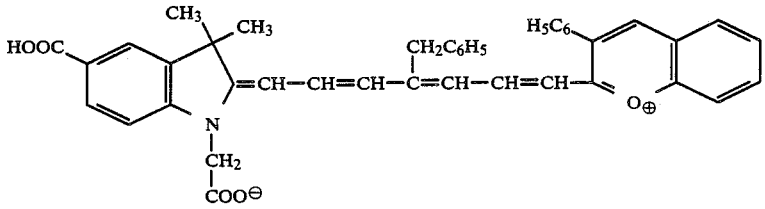

Compound (21)

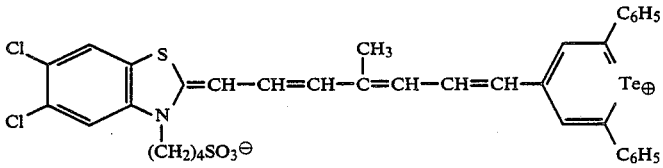

Compound (22)

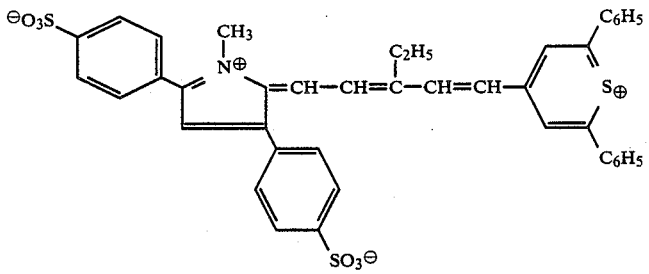

The polymethine dyes of the present invention represented by formula (I) can be prepared by known methods. For example, the dyes of the present invention can be prepared by condensing a substituted pyrylium salt or a quaternary salt of a nitrogen-containing heterocyclic ring with a compound represented by formula (II) below and then condensing the resulting condensate with the remaining pyrylium salt or heterocyclic ring quaternary salt. Formula (II):

$$X_1—NH—L=L)_{r-1}CH=N—X_2$$

wherein L and r are defined as in formula (I), and $X_1$ and $X_2$ each represents a phenyl group, a tolyl group, a xylyl group or a substituted phenyl group, e.g., a chlorophenyl group and a nitrophenyl group.

The substituted pyrylium salt can be prepared according to the methods described in, for example, J.

Kuthan, *Advances in Heterocyclic Chemistry,* Vol. 34, p. 146 (1983), U.S. Pat. No. 4,283,375, and R. J. Murry, *J. Org. Chem.,* 47, 5235 (1982).

The quaternary salt of a nitrogen-containing heterocyclic ring can be prepared according to the method described in, for example, G. F. Duffin, *Advances in Heterocyclic Chemistry,* Vol. 3, p. 1 (1964).

In addition, various methods can be used for preparation of the above compounds, including the methods described in T. H. James ed., *The Theory of the Photographic Process,* pages 194 to 234 (4th ed., Macmillan Publishing Co., New York, 1977) and F. M. Hamer ed., *The Cyanine Dyes and Related Compounds* (John Wiley & Sons Co., New York, 1964).

The polymethine dyes of formula (I) are used as a sensitizer for the inorganic photoconductive material for the purpose of improving photoconductivity, storage stability and sensitivity of various photoconductive materials. Inorganic photoconductive materials which can be used include zinc oxide, titanium oxide, zinc sulfide, and calcium sulfide, etc.

The photoconductive composition of the present invention is excellent in stability as compared with compositions using conventional sensitizing dyes for red light to infrared. Furthermore, since the sensitizing dyes which are used in the present invention contain at least one carboxyl group or sulfo group, they have improved adsorption properties onto the above-described inorganic photoconductive materials. Thus, the spectral sensitization can be markedly increased and, as a result, the spectral sensitivity can be greatly improved.

The sensitizing dyes which are used in the present invention can be incorporated into the photoconductive composition in a conventional manner. Particularly useful procedures include a method in which a photoconductive material is dispersed in a resin binder and then a solution of a dye is added thereto, or a method in which an inorganic photoconductive material is added to a solution of the dye to adsorb the dye and then the adsorbed photoconductive material is dispersed in a resin binder.

The amount of the sensitizing dye used in the present invention varies in a wide range depending on the necessary degree of sensitization. That is, the amount of the sensitizing dye can range from about 0.0005 to 2.0 parts by weight, and preferably from about 0.001 to 1.0 part by weight per 100 parts by weight of the photoconductive material.

The sensitizing dyes used in the present invention can be incorporated into a light-sensitive layer, alone or in combination of two or more dyes. The sensitizing dyes of the present invention are effective for spectral sensitization in the range from red light to infrared. In addition, depending on the purpose, the sensitizing dyes of the present invention can be used in combination with conventionally known spectral sensitizing dyes for visible light (e.g., fluoresceine, Rose Bengale and Rhodamine B). For increasing the spectral sensitization of zinc oxide which is one of the photoconductive materials, an acid anhydride (e.g., phthalic anhydride) can be added to zinc oxide. Since the sensitizing dyes of the present invention are sufficiently high in stability and adsorption onto inorganic photoconductive materials, various additives for conventional electrophotographic light-sensitive layers can be used in combination therewith.

As the binder to be used in the present invention any conventionally known binders can be used. Typical examples of such binders include a vinyl chloride-vinyl acetate copolymers, a styrene-butadiene copolymer, a styrene-butyl methacrylate copolymer, polymethacrylate, polyacrylate, polyvinyl acetate, polyvinyl butyral, an alkyd resin, a silicone resin, an epoxy resin, an epoxy ester resin and a polyester resin. Furthermore, they can be used in combination with aqueous acryl ester emulsions.

In general, the amount of the resin binder in the photoconductive composition of the present invention can be widely varied. The amount of the resin can be in the range of from about 10 to 90% by weight, preferably about 15 to 60% by weight based on the total weight of the photoconductive material and the resin.

In general, sensitizing dyes are readily oxidizable, and, thus, it is not desirable to use the dyes in combination with a compound which catalytically accelerates the oxidation. For example, care should be taken in using peroxides such as benzoyl peroxide among vinyl polymerization initiators, or the organic acid salts of heavy metals which accelerate the hardening of unsaturated fatty acids. In this respect, even with the sensitizing dyes used in the present invention, care should be taken to the same extent as in the case of conventional sensitizing dyes. However, conventional sensitizing dyes for red light to infrared have the disadvantage that they tend to be decomposed within a short time even when the dyes are not used in combination with the above oxidation accelerating agents. If, however, the dyes of formula (I) are used, the stability is greatly increased.

The electrophotographic light-sensitive layer of the present invention can be applied to a conventionally known support. Generally speaking, the support for the electrophotographic light-sensitive layer is preferably electrically conductive. For example, a metallic plate, a plastic film provided with an electrically conductive layer such as a thin layer of aluminum, palladium, indium oxide, tin oxide, cuprous iodide, etc., paper treated to make it electrically conductive, and the like can be advantageously used. Agents which can be used for making the paper support electrically conductive include quaternary ammonium salt-containing polymers, e.g., polyvinylbenzyl trimethylammonium chloride, polymers containing quaternary nitrogen in the main chain thereof as described in U.S. Pat. Nos. 4,108,802, 4,118,231, 4,126,467 and 4,137,217, and quaternary salt polymer latexes as described in Japanese Patent Application (OPI) No. 20977/79 (U.S. Pat. No. 4,147,550 and *Research Disclosure,* No: 16258), polystyrene sulfonic acid salts, and colloidal alumina. Usually, these agents are used in combination with polyvinyl alcohol, styrene-butadiene latex, gelatin or casein.

The organic solvents which can be used for dispersion include volatile hydrocarbon solvents having a boiling point of not more than 200° C. Particularly preferred solvents are halogenated hydrocarbons having 1 to 3 carbon atoms, such as dichloromethane, chloroform, 1,2-dichloroethane, tetrachloroethane, dichloropropane and trichloroethane. In addition, various solvents and mixtures thereof which are used in coating compositions, for example, aromatic hydrocarbons such as chlorobenzene, toluene, xylene and benzene, ketones such as acetone and 2-butanone, ethers such as tetrahydrofuran, and methylene chloride can be used. The solvent can be used in an amount of from about 1 to 100 g, preferably about 5 to 20 g, per gram of the total weight of the dye, the photoconductive material and other additives.

The thickness of the photocondctive composition layer on the support can be varied in a wide range. Usually the photoconductive composition can be coated in a thickness ranging from about 10 microns to about 300 microns (wet thickness before drying). It has been found that the preferred coating thickness prior to drying is in the range of about 50 to 150 microns, though good results can be obtained outside the above range. A preferred dry thickness is in the range of from about 1 to about 50 microns.

The photoconductive composition of the present invention can be used in preparation of a light-sensitive layer (photoconductive layer) of a single layer type electrophotographic light-sensitive material. In addition, the photoconductive composition of the present invention can be used as a charge carrier-generating layer of the complex layer type electrophotographic light-sensitive material having a charge carrier-generating layer and a charge carrier-transporting layer. Furthermore, it can be used as photoconductive light-sensitive particles or a photoconductive composition to be incorporated thereinto, as used in photoelectrophoresis electrophotography.

The photoconductive composition of the present invention can be used as a photoconductive layer of a camera tube of a video camera which is sensitive to red light or infrared light, and also as a red light or infrared-sensitive photoconductive layer of a solid camera tube element having a light receiving layer (photoconductive layer) which is provided on the whole surface of a semiconductor circuit arranged mono- or di-dimensionally for signal transportation or scanning.

The present invention is further described in greater detail with reference to the following examples, but the present invention is not to be construed as being limited thereto. Unless otherwise indicated, all parts, percents, ratios and the like are by weight.

EXAMPLE 1 AND COMPARATIVE EXAMPLE 1

Each of Comparative Compound (A) as shown below and Compound (2) of the present invention was dissolved in methanol to prepare dye solution having a concentration of $1.0\times10^{-3}$ mol/liter.

Comparative Compound (A)

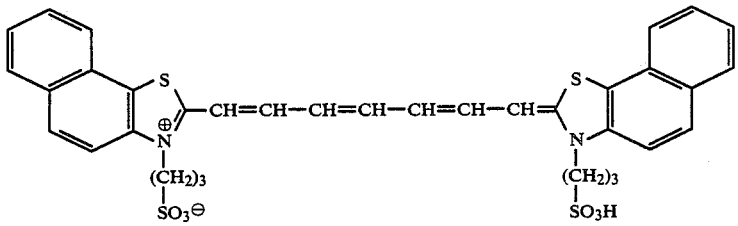

The solution containing the comparative compound had a maximum absorption at a wavelength of 799 nm, and the solution containing invention compound (2) had a maximum absorption at a wavelength of 769 nm.

100 parts of finely divided zinc oxide (average particle diameter: 0.5 to 1 μm, Sazex 2000, a trade name of Sakai Kagaku Co., Ltd.), 30 parts of a 40 wt % toluene solution of an acrylic ester resin (Dianal LR009, a trade name of Mitsubishi Rayon Co., Ltd.), 60 parts of toluene, and 8 parts of each of the above-prepared methanolic solutions of Compound (A) and Compound (2) were mixed and kneaded for 2 hours in a porcelain ball mill to prepare two dispersions. Each dispersion was coated on an aluminum foil in a dry thickness of about 8 μm and dried for 2 hours in a thermostat maintained at 50° C. to form an electrophotographic light-sensitive layer. The electrophotographic light-sensitive layer was measured for spectral reflectance. With this layer, a spectral photograph was taken according to the usual electrophotographic method using a liquid developer with carbon black as a toner.

In the electrophotographic light-sensitive layer containing Compound (2) of the present invention, the maximum absorption was observed at a wavelength of 784 nm, whereas in the electrophotographic light-sensitive layer containing Comparative Compound (A), no absorption was observed in the neighborhood of 800 nm wavelength.

As a result of spectral photographic analysis, it was found that the electrophotographic light-sensitive layer containing Compound (2) of the present invention showed a response in the neighborhood of 380 nm wavelength, which was the light-sensitive region inherent to ZnO, and also a sensitivity due to spectral sensitization in the wavelength region corresponding to the above-described spectral reflectance. On the other hand, the electrophotographic light-sensitive layer containing Comparative Compound (A) showed no response in addition to that of the inherent light-sensitive region of ZnO. These results demonstrated that the electrophotographic light-sensitive layer containing Comparative Compound (A) was not spectrally sensitized.

It is considered that spectral sensitization did not occur because Comparative Compound (A) was decomposed and disappeared because of its instability. It is considered that the dye was decomposed during the process of dispersion because, in preparing the dispersion of the composition, the dye and zinc oxide, etc. were added and then dispersed for 2 hours in a ball mill. On the other hand, the sensitizing dye of the present invention was stable under the processing conditions as described above and showed a spectral sensitization activity.

EXAMPLE 2 AND COMPARATIVE EXAMPLE 2

Using each of the same two compounds as used in Example 1, electrophotographic light-sensitive layers were formed by a method different from that used in Example 1.

100 parts of finely divided zinc oxide (average particle diameter: 0.5 to 1 μm; Sazex 2000, a trade name of Sakai Kagaku Co., Ltd.), 35 parts of a 25 wt % toluene solution of a styrenated alkyd resin (Styresol #4250 produced by Nippon Reichhold Co., Ltd.), and 40 parts of toluene were mixed and kneaded for 2 hours in a porcelain ball mill to form a white dispersion. To this dispersion, 15 parts of a 25 wt % butyl acetate solution of a polyisocyanate resin (Banok D-750, a trade name of Nippon Reichhold Co., Ltd.) was added, and the resultant mixture was well stirred and then divided into two portions. Then, 10 parts of each of the two methanolic solutions shown in Example 1 was added thereto, and the resulting mixture was well stirred. Each of the two dispersions thus-prepared was coated on an aluminum foil in a dry thickness of 10 μm and then dried for 15 hours in a thermostat maintained at 50° C. to obtain two types of electrophotographic light-sensitive materials.

The materials having the electrophotographic light-sensitive layers containing Comparative Compound and Compound (2) were designated as a "Comparative Sample" and "Sample No. 1", respectively.

These two samples were measured for spectral reflectance and spectral sensitivity according to the electrophotographic method. The two samples were measured for absorbance at the absorption maximum wavelength in the wavelength region of 700 to 850 nm of the spectral reflectance just after preparation and also after storage for 1 week under conditions of 50° C. and 80% relative humidity (accelerated aging test). The value obtained by dividing the absorbance after the accelerated aging test by absorbance just after the preparation was referred to as a "stability value", and based on the stability value, the degree of stability was estimated. As the stability value approaches 1, the stability is higher. The stability values are shown in Table 1. In this example and comparative example, in order to prevent the decomposition of the dye during the process of preparation of the light-sensitive layer, the zinc oxide and the resin were previously dispersed, and then the dye was added thereto. Moreover, in order to inhibit the acceleration of decomposition of the dye, a resin having an acid value of 0 was used. In the comparative sample, just after preparation, the maximum reflectance was observed at two points in the neighborhood of a wavelength of 800 nm (corresponding to the absorption maximum wavelength of the comparative compound) and in the neighborhood of a wavelength of 380 nm (corresponding to the absorption maximum wavelength of ZnO). After the accelerated aging test, however, the maximum reflectance in the neighborhood of a wavelength of 800 nm disappeared and the spectral absorbance curve became flat, and thus only the maximum reflectance in the neighborhood of 380 nm was observed. This fact showed that Comparative Compound (A) in the electrophotographic light-sensitive layer disappeared under the accelerated aging test conditions.

TABLE 1

| | Comparative Sample | Sample No. 1 |
|---|---|---|
| Degree of Stability | 0.0 | 0.93 |

With respect to Sample No. 1, the degree of spectral sensitization just after the preparation and after the acceleration test were measured, and a spectral sensitization ratio nearly equal to the above stability value was obtained. These results indicate that both just after preparation and after the accelerated aging test, the desired spectral sensitization was realized to nearly the same extent by Compound (2).

EXAMPLE 3

The procedure described in Examples 1 and 2 was repeated with the exception that paper and a plastic film were used as supports for the electrophotographic light-sensitive layer, and substantially equivalent results to that obtained in Example 1 or 2 were obtained. The paper support used was a high quality paper (weighing 76 g/m$^2$) impregnated with 5 g/m$^2$ of a composition of polyvinyl alcohol/polyvinylbenzyl trimethylammonium chloride (6/5 by weight). The surface electric resistance of the paper support was $5\times10^{18}$ Ω at 25° C. and 50% relative humidity. The plastic film used was an electrically conductive transparent parent film having a thickness of 100 μm on which indium oxide had been vacuum deposited. The surface resistance of the plastic film was $4\times10^{4}$ Ω.

EXAMPLE 4

An electrophotographic light-sensitive material was prepared in the same manner as described in Example 1 except that Compound (5) was used as a dye in place of Compound (2). This light-sensitive material was charged to −400 V by application of corona discharge of −6 KV, and the exposure amount required for the potential to decay to ½, that is, the half decay exposure amount $E_{\frac{1}{2}}$ (erg/cm$^2$) was measured and found to be 50.5. As the light source, a gallium-aluminum-arsenic semiconductor laser (oscillation wavelength 780 nm) was used.

After the light-sensitive material was stored for one week under conditions of 50° C. and 80% relative humidity, $E_{178}$ was measured under the same conditions as above and found to be 51.2, which indicated substantially no change.

EXAMPLE 5 AND COMPARATIVE EXAMPLE 3

Two electrophotographic light-sensitive materials were produced in the same manner as described in Example 1 except that Compound (6) and Comparative Compound (B) as shown below were used as dyes in place of Compound (2) and Comparative Compound (A).

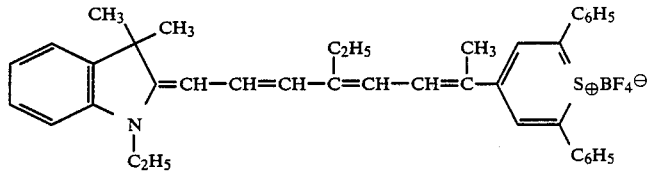

The spectral reflectance of each light-sensitive material was measured in the same manner as described in Example 1. In both Compound (6) and Comparative Compound (B), a spectral absorption was clearly present in a region of 750 to 800 nm. The light-sensitive material was charged to −400 V by application of corona discharge of −6 KV, and the half-decay exposure amount ($E_{\frac{1}{2}}$ (erg/cm$^2$)) was measured. The light-sensitive material containing Compound (6) of the present invention had an $E_{\frac{1}{2}}$ of 51.0, whereas the light-sensitive material containing Comparative Compound (B) had the predetermined spectral absorption wavelength, but no $E_{\frac{1}{2}}$ at all. As the light source, a semiconductor laser having an oscillation wavelength of 780 nm was used.

EXAMPLES 6 TO 15

Electrophotographic light-sensitive materials were produced in the same manner as described in Example 1 except that each of the compounds shown in Table 2 was used as a dye in place of Compound (2).

The resulting light-sensitive materials were corona discharged to −6 KV by the static system using a paper analyzer (SP-428, a product of Kawaguchi Denki Co., Ltd.), stored for 30 seconds in a dark place, and exposed to light at a density of illumination of 2 lux to examine charging characteristics. As the charging characteristics, the ratio of the potential after decay for 30 seconds in a dark place to the initial potential ($V_0$), that is, the dark decay retention ratio (DRR(%)) was measured, and also $E_{\frac{1}{2}}$ (erg/cm$^2$) was measured in the same manner as described in Example 1. The results obtained are shown in Table 2 below.

TABLE 2

| Example No. | Compound* | $V_0$ (−V) | DRR (%) | $E_{\frac{1}{2}}$(erg/cm$^2$) |
|---|---|---|---|---|
| 6 | (2) | 570 | 88 | 71.6 |
| 7 | (3) | 575 | 89 | 69.8 |
| 8 | (7) | 565 | 87 | 70.5 |
| 9 | (8) | 560 | 86 | 65.3 |
| 10 | (9) | 555 | 84 | 60.9 |
| 11 | (10) | 565 | 83 | 59.8 |
| 12 | (12) | 550 | 87 | 55.4 |
| 13 | (15) | 555 | 86 | 54.6 |
| 14 | (17) | 560 | 84 | 58.7 |
| 15 | (19) | 575 | 85 | 54.3 |

*The compound number corresponds to that shown previously.

In the present invention, the use of the sensitizing dyes as described above permits an electrophotographic light sensitive layer containing sensitizing dyes for red to infrared light to be stored for a long term. The present invention is effective for preventing the decomposition of sensitizing dyes during the process for preparing a light-sensitive layer, and, even if the light-sensitive layer is tested under severe conditions, i.e., at a temperature of 50° C. and a relative humidity of 80%, it exhibits excellent stability as compared with conventional sensitizing dyes for red light to infrared.

The sensitizing dyes of the present invention are highly stable, and can be handled in the same manner as sensitizing dyes commonly used for visible light. That is, it is not necessary to carefully control conditions for dispersion and mixing, or carefully select the time at which they are added. Accordingly, the present invention advantageously simplifies the process for preparing the lightsensitive material, and the quality and performance of the light-sensitive material are stabilized.

If conventional sensitizing dyes and inorganic photoconductive materials are used together, the conventional sensitizing dyes are easily decomposable, particularly under irradiation by light. Thus, when conventional sensitizing dyes for red to infrared light are used, the preparation of the light-sensitive layer should be performed in the dark.

Moreover, since the sensitizing dyes of the present invention contain at least one carboxyl group or sulfo group in the molecule thereof, their adsorption onto inorganic photoconductive substances is increased, and thus spectral sensitization efficiency is greatly increased and spectral sensitivity is greatly improved.

While the invention has been described in detail and with reference to specific embodiments thereof, it will be apparent to one skilled in the art that various changes and modifications can be made therein without departing from the spirit and scope thereof.

What is claimed is:

1. A photoconductive composition comprising an inorganic photoconductive material, a resin binder, and a sensitizing amount of a sensitizing dye containing at least one sulfo group represented by formula (I):

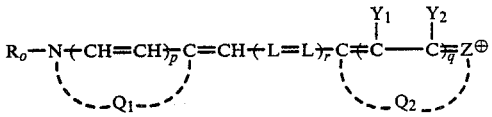

(I)

wherein:

$Q_1$ is a substituted or unsubstituted atomic group necessary for forming a 5-membered or 6-membered heterocyclic ring or a condensed ring containing a 5-membered or 6-membered heterocyclic ring;

$R_0$ is an alkyl group, a hydroxyalkyl group, an alkoxyalkyl group, an aralkyl group, a carboxyalkyl group, or a sulfoalkyl group;

Z is an oxygen atom, a sulfur atom, a selenium atom or a tellurium atom;

$Q_2$ is a substituted or unsubstituted atomic group necessary for forming pyrylium, benzopyrylium, naphthopyrylium, thiopyrylium, benzothiopyrylium, naphthothiopyrylium, selenapyrylium, benzoselenapyrylium, naphthoselenapyrylium, ternapyrylium, benzoternapyrylium, or naphtoterhnapyrylium, which may be substituted;

$Y_1$ and $Y_2$, which may be the same or different, each is a hydrogen atom, an aliphatic group or an aromatic group;

each L is a methine group or a substituted methine group;

p and q each is 0 or 1;

r is 2 or 3; and the compound of formula (I) forms an inner salt.

2. The photoconductive composition as claimed in claim 1, wherein $Q_1$ represents an atomic group necessary for forming a thiazole ring, a benzothiazole ring, a naphthothiazole ring, a thionaphthene[7,6-d] ring, an oxazole ring, a benzoxazole ring, a naphthoxazole ring, a selenazole ring, a benzoselenazole ring, a naphthoselenazole ring, an oxazolone ring, a selenazoline ring, a thiazoline ring, a pyridine ring, a quinoline ring, an isoquinoline ring, an acridine ring, a 3,3-di-alkylindolenine ring, or a benzoimidazole ring, and the substituent for said substituted group is selected from the group consisting of a halogen atom, a substituted or unsubstituted alkyl group having 1 to 22 carbon atoms, a substituted or unsubstituted aralkyl group having 7 to 22 carbon atoms, a substituted or unsubstituted aryl group having 6 to 22 carbon atoms, a substituted or unsubstituted heterocyclic group containing at least 4 carbon atoms, a hydroxyl group, a cyano group, a nitro group, a carboxyl group, a sulfo group, an alkoxy group containing 1 to 22 carbon atoms, an aryloxy group containing 6 to 22 carbon atoms, a carboxylic acid ester group, an amino group, a monosubstituted amino group, a disubstituted amino group, a substituted or unsubstituted alkylsulfonyl group containing 1 to 22 carbon atoms, a substituted or unsubstituted arylsulfonyl group containing 6 to 22 carbon atoms, a substituted or unsubstituted acyl group containing 2 to 22 carbon atoms, a substituted or unsubstituted carbonamido group containing 1 to 22 carbon atoms and a substituted or unsubstituted sulfonamido group containing 1 to 22 carbon atoms.

3. The photoconductive composition as claimed in claim 1, wherein each said alkyl moiety contained in $R_0$ contains from 1 to 18 carbon atoms.

4. The photoconductive composition as claimed in claim 1, wherein said substituted atomic group represented by $Q_2$ is substituted with a substituent selected from the group consisting of a halogen atom, a substituted or unsubstituted alkyl group containing 1 to 22 carbon atoms, an alkoxy group containing 1 to 20 carbon atoms, a substituted or unsubstituted aralkyl group containing 7 to 22 carbon atoms, a substituted or unsubstituted aryl group containing 6 to 22 carbon atoms, a hydroxyl group, a cyano group, an alkyloxycarbonyl group containing 1 to 22 carbon atoms, an aryloxycarbonyl group containing 6 to 22 carbon atoms, an alkanesulfonyl group containing 1 to 22 carbon atoms, an arylsulfonyl group containing 6 to 22 carbon atoms, and a substituted or unsubstituted amino group containing 1 to 28 carbon atoms.

5. The photoconductive composition as claimed in claim 1, wherein $Y_1$ and $Y_2$ each is a hydrogen atom, a substituted or unsubstituted alkyl group containing 1 to 22 carbon atoms, a substituted or unsubstituted cycloalkyl group containing 5 to 22 carbon atoms, a substituted or unsubstituted aralkyl group containing 7 to 22 carbon atoms, or a substituted or unsubstituted aryl group containing 6 to 22 carbon atoms.

6. The photoconductive composition as claimed in claim 1, wherein said methine group represented by L is substituted with a substituent selected from the group consisting of a halogen atom, a carboxyl group, a hydroxyl group, an alkyl group containing 1 to 5 carbon atoms, an alkoxy group containing 1 to 5 carbon atoms, an aralkyl group containing 7 to 12 carbon atoms, a substituted or unsubstituted aryl group, and

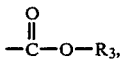

wherein $R_3$ represents an alkyl group, an aralkyl group or an aryl group.

7. The photoconductive composition as claimed in claim 1, wherein at least one of $Q_1$, $R_0$, and L contains $-SO_3^{\ominus}$.

8. The photoconductive composition as claimed in claim 1, wherein said inorganic photoconductive material is selected from the group consisting of zinc oxide, titanium oxide, zinc sulfide and calcium sulfide.

9. The photoconductive composition as claimed in claim 1, comprising from about 0.0005 to 2.0 parts by weight of said sensitizing dye per 100 parts by weight of said photoconductive material, and about 10 to 90 parts by weight of said resin per 100 parts of the total weight of said photoconductive material and said resin.

10. The photoconductive composition as claimed in claim 9, comprising from about 0.001 to 1.0 part by weight of said sensitizing dye per 100 parts by weight of said photoconductive material, and about 15 to 60 parts by weight of said resin per 100 parts of the total weight of said photoconductive material and said resin.

11. A photoconductive composition comprising a support thereon a photoconductive layer comprising a photoconductive composition comprising an inorganic photoconductive material, a resin binder, and a sensitizing amount of a sensitizing dye containing at least one sulfo group represented by formula (I):

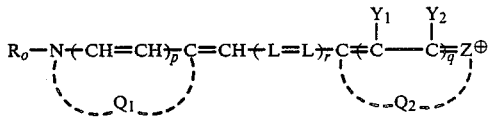

(I)

wherein:

$Q_1$ is a substituted or unsubstituted atomic group necessary for forming a 5-membered or 6-membered heterocyclic ring or a condensed ring containing a 5-membered or 6-membered heterocyclic ring;

$R_o$ is an alkyl group, a hydroxyalkyl group, an alkoxyalkyl group, an aralkyl group, a carboxyalkyl group, or a sulfoalkyl group;

Z is an oxygen atom, a sulfur atom, a selenium atom or a tellurium atom;

$Q_2$ is a substituted or unsubstituted atomic group necessary for forming pyrylium, benzopyrylium, naphthopyrylium, thiopyrylium, benzothiopyrylium, naphthothiopyrylium, selenapyrylium, benzoselenapyrylium, naphthoselenapyrylium, ternapyrylium, benzoternapyrylium, or naphthoternapyrylium, which may be substituted;

$Y_1$ and $Y_2$, which may be the same or different, each is a hydrogen atom, an aliphatic group or an aromatic group;

each L is a methine group or a substituted methine group;

p and q each is 0 or 1;

r is 2 or 3; and the compound of formula (I) forms an inner salt.

12. The photoconductive material as claimed in claim 11, wherein said photoconductive layer is from about 1 to 50 μm thick.

13. The photographic material as claimed in claim 1, wherein said sensitizing dye is present in an amount of from 0.005 to 2.0 parts by weight per 100 parts by weight of the photoconductive material.

14. The photographic material as claimed in claim 11, wherein said sensitizing dye is present in an amount of from 0.005 to 2.0 parts by weight per 100 parts by weight of the photoconductive material.

* * * * *